United States Patent [19]

Hayden et al.

[11] 4,109,613

[45] Aug. 29, 1978

[54] STEAM BOILERS

[75] Inventors: Robert Leslie James Hayden, London; Alan Bell, Cookham, both of England

[73] Assignee: Foster Wheeler Energy Corporation, Livingston, N.J.

[21] Appl. No.: 803,817

[22] Filed: Jun. 6, 1977

[30] Foreign Application Priority Data

Jun. 5, 1976 [GB] United Kingdom ..... 18441/76

[51] Int. Cl.[2] ..... F22B 33/00; F23C 1/08; F22G 1/00

[52] U.S. Cl. ..... 122/1 R; 110/302; 122/240 B; 122/479 E; 122/7 B; 431/12

[58] Field of Search ..... 122/1 R, 7 B, 235 R, 122/240 R, 240 A, 240 B, 479 E, 485; 431/12; 110/1 P, 7 B, 22 R, 22 A

[56] References Cited

U.S. PATENT DOCUMENTS

| | | | |
|---|---|---|---|
| 2,867,195 | 1/1959 | Hauck et al. | 122/240 |
| 2,867,983 | 1/1959 | Armacost | 122/485 |
| 3,135,244 | 6/1964 | Caracristi | 122/240 |
| 3,135,245 | 6/1964 | Powell et al. | 122/240 |
| 3,135,314 | 6/1964 | Brunner | 431/12 X |
| 3,166,909 | 1/1965 | Best, Jr. | 122/240 |
| 3,241,597 | 3/1966 | Juzi | 431/12 X |

*Primary Examiner*—Kenneth W. Sprague
*Attorney, Agent, or Firm*—Marvin A. Naigur; John E. Wilson

[57] ABSTRACT

There is always a danger of slagging on and/or corrosion of the tubes of the highest temperature superheater bank and, if present, reheater bank when burning heavy bunker fuel oil. Therefore a clean fuel burning furnace is provided which is separate from the heavy bunker fuel oil burning furnace and only the combustion gases from burning the clean fuel are used to heat the highest temperature superheater bank and, if present, reheater bank. The clean fuel is preferably provided by a gasifier in which a portion of the heavy bunker fuel oil is precombusted to give a clean combustible fuel gas.

10 Claims, 1 Drawing Figure

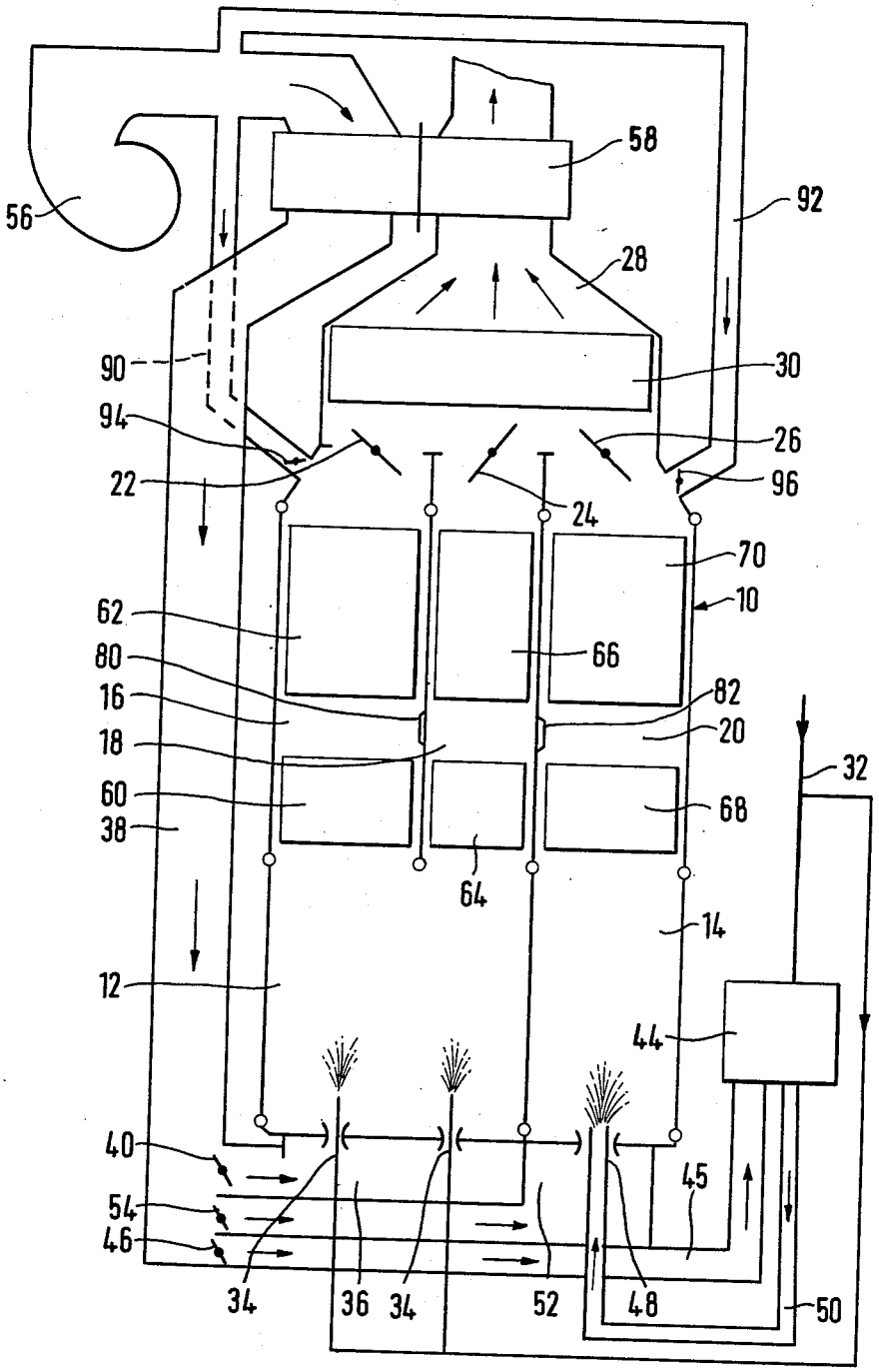
58
56
92
28
90
30
94
26
22
96
24
70
10
62
66
80
82
16
20
18
32
60
68
38
64
14
12
44
40
45
54
46
34
36
34
52
48
50

STEAM BOILERS

This invention relates to steam boilers and in particular marine steam boilers used to supply steam to the steam turbines powering a ship.

BACKGROUND TO THE INVENTION

In marine steam boilers providing high temperature and pressure superheat and reheat steam there is a danger of slagging and/or corrosion of the tubes forming at least the highest temperature superheater and reheater bank when burning heavy bunker fuel oil which has a high ash and sulphur content. It is therefore an object of this invention to reduce this slagging and/or corrosion in such steam boilers.

BRIEF SUMMARY OF THE INVENTION

According to the invention there is provided a steam boiler having a heavy oil burning furnace and a separate clean fuel burning furnace, and a number of tube banks providing one or more stages of superheated steam and optionally one or more stages of reheated steam, the tube banks being arranged so that the tubes of the highest temperature superheater tube bank and of the or the highest temperature reheater tube bank if provided are heated by the combustion products from the clean fuel burning furnace.

In such a boiler the slagging on and/or corrosion of the tubes of the highest temperature superheater tube bank and reheater tube bank is larged avoided because those tubes are contacted solely by the clean combustion gases from the clean fuel burning furnace. The other tubes of any lower temperature superheater and reheater tube ganks can be swept by the combustion gases from the heavy fuel oil burning furnace but for these tubes which operate at lower temperatures the risks of slagging and/or corrosion are less.

The clean fuel for the clean fuel burning furnace can be provided by the pre-combustion of heavy fuel in a gasifier which can provide a supply of clean product gas for burning whilst retaining the impurities in the heavy fuel. These gasifiers are known and can take the form of a fluidized bed gasifier.

Under no-steam flow conditions in the reheater, cooling air must be passed over the tubes of the reheater tube bank or banks. This can be achieved by positioning the bank or banks in gas passes whose outlets under such conditions can be closed by dampers and cooling air can then be fed in reverse flow through the pass or passes directly from an air supply fan such as the forced draught fan for the combustion air.

Separate forced draught fans and air pre-heaters can be provided for each furnace if required to provide air for the furnaces and/or the gasifier. This may serve to avoid the back-feed of contaminants from the air preheating system for the clean fuel burning furnace by the air supply to the heavy oil burning furnace so as to ensure that the combustion products from the clean fuel burning furnace remain clean.

BRIEF SUMMARY OF THE DRAWINGS

An example of a marine steam boiler according to the invention will now be described with reference to the accompanying drawing which is a sectional diagram of the boiler.

DESCRIPTION OF THE PREFERRED EMBODIMENT

The boiler 10 shown in the drawing has a heavy fuel oil burning furnace 12 and a separate clean fuel gas burning furnace 14. The combustion gases from the furnace 12 pass up through two parallel passes 16 and 18 while the combustion gases from the furnace 14 pass up through a pass 20. The flow of gases through the passes 16, 18 and 20 are controlled by dampers 22, 24 and 26, respectively. The gases from all three passes are thereafter combined in a common flue 28 containing an economiser tube bank 30. The walls of the furnaces 12 and 14 and passes 16, 18 and 20 are defined by conventional water tube walls which are not shown in detail.

The furnace 12 is fired by heavy fuel oil from a supply 32. The heavy fuel oil is burned by burners 34 and combustion air is supplied from a windbox 36. Air for this windbox is supplied from a common duct 38 and its rate of supply is controlled by a damper 40.

The furnace 14 is fired by clean gas from a gasifier 44. This gasifier receives heavy fuel oil from the supply 32 and air from the common duct 38 via a passage 39 at a rate determined by a damper 46 and converts the oil to a clean combustible gas which is fed to a burner 48 in the furnace 14 via a duct 50. Combustion air for the furnace 14 is supplied to a windbox 52 from the common duct 38 and the rate of supply is controlled by a damper 54.

The air supply to the common duct 38 is made from a forced draught fan 56, the air being preheated in a regenerative air heater 58 heated by the combined combustion gases in the flue 28.

The pass 16 contains a first or low temperature superheater 60 and a first or low temperature reheater 62 while the pass 18 contains a second superheater 64 and a by-pass economiser 66. Dirty combustion gases from the furnace 12 flow over these items. The pass 20 contains a third or final superheater 68 and a second or final reheater 70, this superheater 68 and reheater 70 being the highest temperature superheater and reheater passes, respectively. Clean combustion gases from the furnace 14 pass over these items and to ensure this the damper 26 associated with the pass 20 is controlled to maintain a slight positive pressure differential between that pass and pass 18 at the level of intermediate open screens 80 and 82 provided respectively between the passes 16 and 18 and passes 18 and 20.

These screens 80 and 82 are provided so that the combustion gases can deviate from one pass to another after flow over the first, second or third superheater in dependence upon the positioning of the dampers 22, 24 and 26, the damper 26 being arranged as noted above to ensure that dirty combustion gases do not flow from the pass 18 to the pass 20.

Under no-steam flow conditions through the first and second reheaters 62 and 70, these have to be cooled. Therefore cooling air ducts 90 and 92 lead from the fan 56 to the tops of the passes 16 and 20, respectively. The passage of the cooling air through its ducts 90 and 92 is controlled by dampers 94 and 96, respectively. Thus to prevent flow of hot combustion gases over the reheaters 62 and 70 when they contain no steam, the dampers 22 and 26 are closed, all of the combustion gases then passing over the economiser 66, and cooling air is allowed to flow down over the reheaters 62 and 70 by opening the dampers 94 and 96 and this cooling air then passes through the open screens 80 and 82 to join the combustion products.

If desired a separate forced draught fan can be provided to supply air to the furnace 14 and gasifier 44 and dirt packed up by such air from any air preheater can be fed back into the combustion air for the furnace 12 so as to keep the combustion gases from the furnace 14 clean.

The operation of the boiler 10 should be clear from the above description.

As will be appreciated, the final or third superheater 68 and the final or second reheater 70 both operate at the highest temperatures and so are most liable to be affected by slag and corrosion problems. However, both can only receive clean combustion gases and so problems of slagging and corrosion are reduced as compared with a situation in which they receive combustion gases from the furnace 12.

Although the words water and steam have been used herein those words are to be construed as including any liquid and its vapour unless the context specifically requires otherwise.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

What we claim is:

1. A steam boiler comprising:
a heavy oil burning furnace,
a separate clean fuel burning furnace,
a first pass through which combustion gases from said heavy oil burning furnace travel,
a second pass through which combustion gases from said clean fuel burning furnace travel, and
a superheater tube bank, chosen from a single superheater tube bank and a finishing or highest temperature superheater tube bank, positioned in said second pass and swept by combustion gases from said clean fuel burning furnace.

2. A steam boiler according to claim 1 further comprising a gasifier in which heavy oil can be precombusted to provide a product gas, and means for conveying said product gas to said clean fuel furnace.

3. A steam boiler according to claim 2 in which said gasifier is a fluidised bed gasifier.

4. A steam boiler according to claim 1 further comprising dampers positioned at the outlets from said first and second passes.

5. A steam boiler according to claim 4 further comprising communicating ports provided between said first and second passes at intermediate positions along their length, and means for controlling said damper controlling the flow of gases along said second pass to ensure that there is no flow into that pass from the first pass.

6. A steam boiler comprising:
a heavy oil burning furnace,
a separate clean fuel burning furnace,
a common flue,
a first pass through which combustion gases from said heavy oil burning furnace travel to said flue,
a second pass through which combusion gases from said clean fuel burning furnace travel to said flue,
a superheater tube bank chosen from a single superheater tube bank and a finishing or highest temperature superheater tube bank, positioned in said second pass,
a reheater tube bank, chosen from a single reheater tube bank and a finishing or highest temperature reheater tube bank, positioned in said second pass following said superheater tube bank and also swept by combustion gases from said clean fuel burning furnace, and
heating elements optionally including at least one lower temperature superheater tube bank and at least one lower temperature reheater tube bank positioned in said first pass and swept by combustion gases from said heavy oil burning furnace.

7. A steam boiler as claimed in claim 6 in which said first pass consists of a pair of parallel passes.

8. A steam boiler according to claim 6 further comprising means for passing a flow of cooling air over each reheater tube bank when there is no steam flow through the tubes of the reheater.

9. A steam boiler according to claim 8 in which the flow of cooling air is derived from the combustion air flow and the cooling air is passed in reverse flow over said reheater tube bank to the direction of flow of combustion products.

10. A steam boiler comprising:
a heavy oil burning furnace,
a separate clean fuel burning furnace,
a common flue,
a gas pass for combustion products from said clean fuel burning furnace leading to said common flue,
a high temperature superheater tube bank in said gas pass,
a high temperature reheater tube bank following said high temperature superheater tube bank in said gas pass,
a pair of parallel gas passes for combustion products from said heavy oil burning furnace, at least one lower temperature superheater tube bank positioned in one of said parallel gas passes,
at least one lower temperature reheater tube bank positioned in one of said pair of parallel gas passes,
an economiser tube bank positioned in one of said pair of parallel gas passes,
communication ports between said passes at intermediate positions along their lengths, and
means for supplying a flow of cooling air over each reheater tube bank when there is no steam flow through the reheater tubes, all of the combustion gases and the cooling air then being directed to flow over said economiser tube bank.

* * * * *